US007272863B2

(12) United States Patent
Pratt

(10) Patent No.: US 7,272,863 B2
(45) Date of Patent: Sep. 25, 2007

(54) HANDLED TOILET SEAT

(75) Inventor: Johnnie Pratt, 1532 Havenwood Rd., Suite 204, Baltimore, MD (US) 21218

(73) Assignee: Johnnie Pratt, Blue Springs, MO (US)

( * ) Notice: Subject to any disclaimer, the term of this patent is extended or adjusted under 35 U.S.C. 154(b) by 238 days.

(21) Appl. No.: 11/038,621

(22) Filed: Jan. 21, 2005

(65) Prior Publication Data

US 2006/0162057 A1 Jul. 27, 2006

(51) Int. Cl.
*A47K 13/10* (2006.01)

(52) U.S. Cl. ..... 4/246.1

(58) Field of Classification Search ..... 4/246.1; D23/311; D8/307

See application file for complete search history.

(56) References Cited

U.S. PATENT DOCUMENTS

| | | | | | |
|---|---|---|---|---|---|
| 2,525,492 | A | | 10/1950 | Leidy | |
| 3,191,193 | A | | 6/1965 | Bogenberger | |
| 3,717,884 | A | | 2/1973 | Mantooth | |
| 3,783,455 | A | | 1/1974 | Vanderbrook | |
| 3,935,601 | A | | 2/1976 | Hermann | |
| 4,129,907 | A | * | 12/1978 | Vaughan et al. | 4/246.1 |
| 4,951,324 | A | | 8/1990 | Lirette | |
| 5,086,523 | A | | 2/1992 | De Mott et al. | |
| 5,341,519 | A | | 8/1994 | Cusenza | |
| 5,459,889 | A | * | 10/1995 | Jamison | 4/661 |
| D385,341 | S | * | 10/1997 | Ouzounian | D23/311 |
| 5,729,839 | A | * | 3/1998 | Bigelow | 4/246.1 |
| 5,749,103 | A | | 5/1998 | Kreemer | |
| D414,852 | S | * | 10/1999 | Snook | D23/311 |
| D417,723 | S | | 12/1999 | Ricigliano | |
| 6,009,569 | A | | 1/2000 | Ferrara | |
| D421,491 | S | * | 3/2000 | Hewitt | D23/311 |
| 6,385,782 | B1 | * | 5/2002 | Schneider | 4/239 |
| 6,634,032 | B1 | * | 10/2003 | Janik | 4/246.1 |
| 6,691,330 | B2 | | 2/2004 | Baker | |
| 2001/0034901 | A1 | | 11/2001 | McEntee, Sr. | |
| 2004/0025234 | A1 | | 2/2004 | Moser et al. | |
| 2004/0107486 | A1 | | 6/2004 | Yoo | |

FOREIGN PATENT DOCUMENTS

| | | |
|---|---|---|
| DE | 10025799 | 11/2001 |
| JP | 10229956 | 9/1998 |
| JP | 11151182 | 6/1999 |

OTHER PUBLICATIONS

"Nifty Lifty," website: http://www.niftylifty.com.
"DaisyLift Porcelain Toilet Seat Handles," website: http://www.boingboing.net/2004/03/18/daisylift_porcelain_.html.

* cited by examiner

*Primary Examiner*—Charles E. Phillips

(57) ABSTRACT

A toilet seat and handle combination comprising a toilet seat and at least one handle. The toilet seat has an upper side and a bottom side, right and left sides, and at least one groove located in the bottom side. The handle comprises at least one section that fits inside the groove, which has sufficient depth to ensure that the section fits at least partially inside the groove with respect to the bottom side of the toilet seat.

6 Claims, 7 Drawing Sheets

HANDLED TOILET SEAT

CROSS-REFERENCE TO RELATED APPLICATIONS

This application claims the benefit of U.S. Provisional Patent Application Ser. No. 10/863,118, filed Jun. 9, 2004.

STATEMENT REGARDING FEDERALLY SPONSORED RESEARCH OR DEVELOPMENT

Not Applicable.

FIELD OF THE INVENTION

This invention relates to a toilet seat with at least one flush fitting or recessed handle.

BACKGROUND OF THE INVENTION

A person such as a senior or someone recovering from a serious injury sometimes finds conventional items around the home awkward to use. Thus, there is a need for household devices that are modified to render such devices easier to use compared to the standard household devices.

The related art of interest describes various toilet seat handles, but none discloses the present invention.

U.S. Pat. No. 3,717,884, issued to Mantooth on Oct. 22, 2002 describes a lifting handle for a toilet seat, consisting of a plate-like flange which is said to be fastened to the underside of a toilet seat by screws, with a laterally projecting hand grip having top and bottom ribs in the form of closed loops. The '884 handles do not sit flush with respect to the bottom of the toilet seat thereby rendering the toilet seat to distortion when under load, i.e. when a user sits on the toilet seat.

U.S. Pat. No. 5,729,839, issued to Bigelow on Mar. 4, 1998 describes an apparatus for raising and lowering a toilet seat and toilet seat cover; the apparatus is said to comprise a pair of handle assemblies that respectively extend radially from the toilet seat and cover. Each handle assembly comprises a U-shaped bracket that is attached to the underside of the toilet seat or cover by screws or other suitable means. Each handle assembly is designed only to withstand the weight of the toilet seat or cover and is not designed to assist a person to sit on or get off a toilet seat.

U.S. Pat. No. 5,749,103, issued to Kreemer on May 12, 1998 describes a substantially annular toilet seat having a lifting surface that is said to remain sanitary throughout a range of toilet seat positions between a toilet bowl and a toilet tank. The toilet seat has what appears to be a protrusion that extends laterally outward from the toilet seat for lifting the toilet seat. The Kremmer U.S. Pat. No. '103 does not suggest or teach a handle or pair of handles designed to assist a person to sit on or get off a toilet seat.

In addition, a design patent to Snook (U.S. Des. 414,852, issued on Oct. 5, 1999) shows a toilet seat handle located at the front of a toilet seat. The Snook design probably allows a user to lift the toilet seat without actually touching the annular part of the toilet seat. Similarly, the NIFTY LIFTY™ and DaisyLift™ both advertise an attachable toilet seat handle that is said to provide a sanitary way to lift and lower a toilet seat.

Other U.S. patents or patent publications known to the inventor in the field of toilet seats and toilet seat handles are: U.S. Des. 417,723, U.S. Pub. No. 20010034901, U.S. Pub. No. 20040025234, U.S. Pub. No. 20040107486, U.S. Pat. Nos. 2,525,492, 3,191,193, 3,783,455, 3,935,601, 4,951,324, 5,086,523, 5,341,519, 6,009,569, 6,385,782, 6,634,032, and 6,691,330.

Foreign patents or patent publications known to the inventor in the field of toilet seats and toilet seat handles are: JP10229956, JP11151182, and DE10025799.

None of the above patents and publications, taken either singularly or in combination, is seen to describe the instant invention as claimed.

SUMMARY OF THE INVENTION

A toilet seat and handle combination comprising a toilet seat and at least one handle. The toilet seat has an upper side and a bottom side, right and left sides, and at least one groove located in the bottom side. The handle comprises at least one section that fits inside the groove, which has sufficient depth to ensure that the section fits at least partially inside the groove with respect to the bottom side of the toilet seat.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a toilet seat with at least one handle to aid a person requiring assistance in handling or otherwise using a toilet seat.

Referring to the FIGURES in general, the invention is a toilet seat 100 combined with at least one handle 120 (e.g., see FIG. 1A) having at least one section 122*g* (e.g., see FIG. 4B) that fully or at least partially fits inside at least one groove 180. The at least one handle 120 acts as a grip that can be used by a person P to sit on or get off the toilet seat 100 and/or to pick up or put down the toilet seat 100. The at least one handle 120 may also be used as handgrips to squeeze, pull on or push against; some people need to grip, pull or push against something while discharging feces from their bowels. In addition, the at least one handle 120 may also be used to lift or lower the toilet seat 100 without having to touch the toilet seat 100.

Figure 1A:
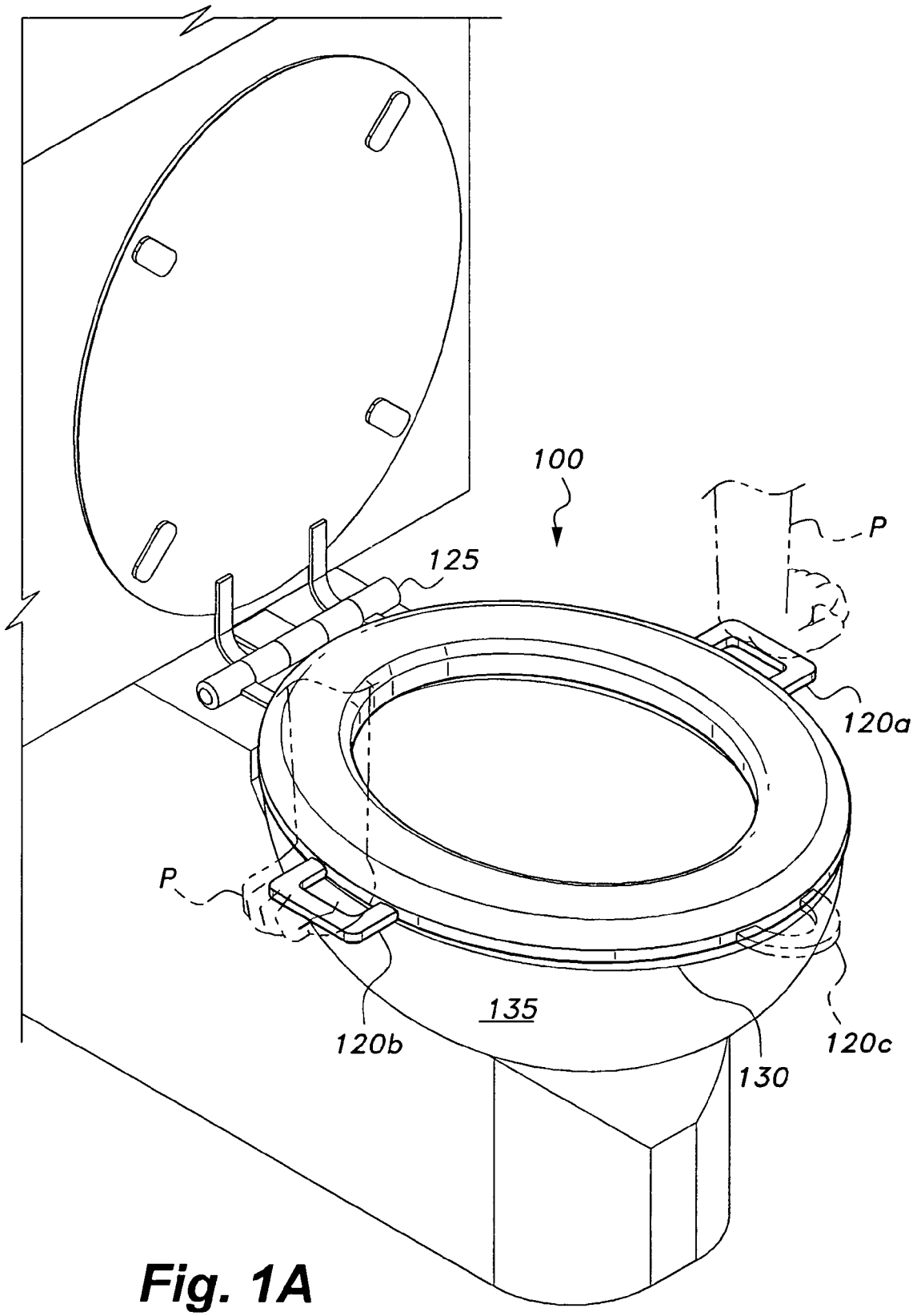
FIG. 1A shows a perspective environmental view of a toilet seat in combination with at least one seat handle according to the present invention.

In more detail, FIG. 1A shows a perspective environmental view of a toilet seat 100 in combination with at least one seat handle 120 according to the invention. Seat handles 120 are attached to toilet seat 100; the seat handles 120 are represented in FIG. 1A by alpha-numeral labels 120*a* and 120*b*, which are respectively flush attached to the right and left sides of toilet seat 100. Person P uses seat handles 120 as an aid in sitting on or getting off toilet seat 100. The toilet seat 100 has a hinged end 125 adapted to attach to bowl rim 130 atop bowl 135. It should be understood that the handles 120 could be attached to any point around the toilet seat 100; specifically, the position of the handles 120 are not limited to the right and left sides of toilet seat 100.

Figure 1B:
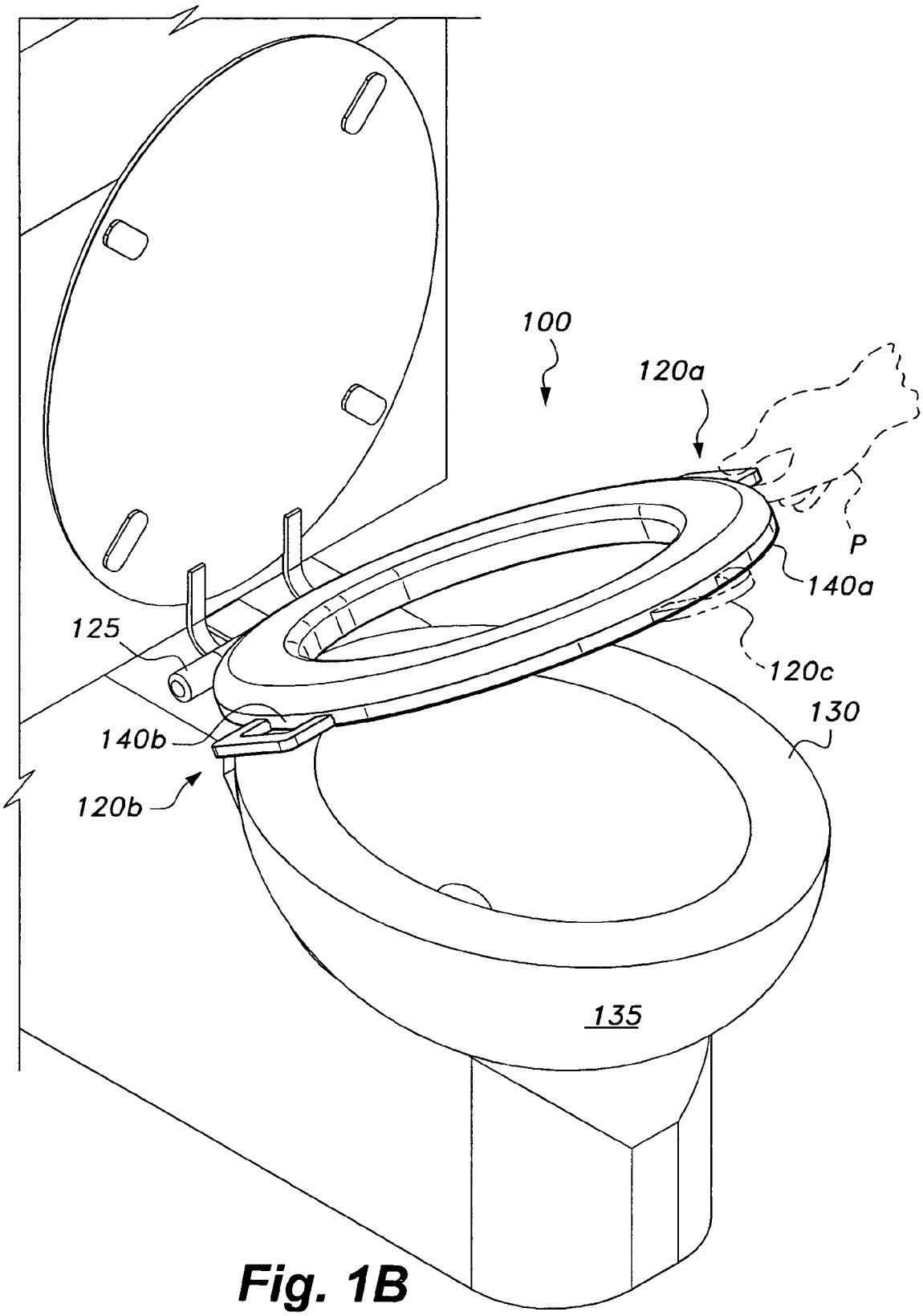
FIG. 1B shows a further perspective environmental view of the toilet seat in combination with at least one seat handle according to the present invention.

FIG. 1B shows a further perspective environmental view of the toilet seat 100 in combination with at least one seat handle 120 according to the invention. Person P uses seat handles 120 as an aid to lift up or put down toilet seat 100 without touching the toilet seat 100. The handles 120*a* and 120*b* extend laterally outwards from right and left sides 140*a* and 140*b*, respectively, of toilet seat 100. More specifically, the seat handles 120 extend outwards from the annular form of the toilet seat 100 as shown, for example, in FIGS. 1A and 1B.

It should be understood that the toilet seat 100 is not limited to an annular shape and can be any suitable shape. For example, toilet seat 100 can adopt an unconventional shape comprising a forward opening and a rearward opening as described in U.S. Pat. No. 4,048,679 issued Sep. 20, 1977 to Garnett; the Garnett U.S. Pat. No. '670 is herein incorporated by reference in its entirety. The toilet seat 100 can be made of any suitable material such as a synthetic or natural material such as polymer and wood, respectively.

Figure 2:
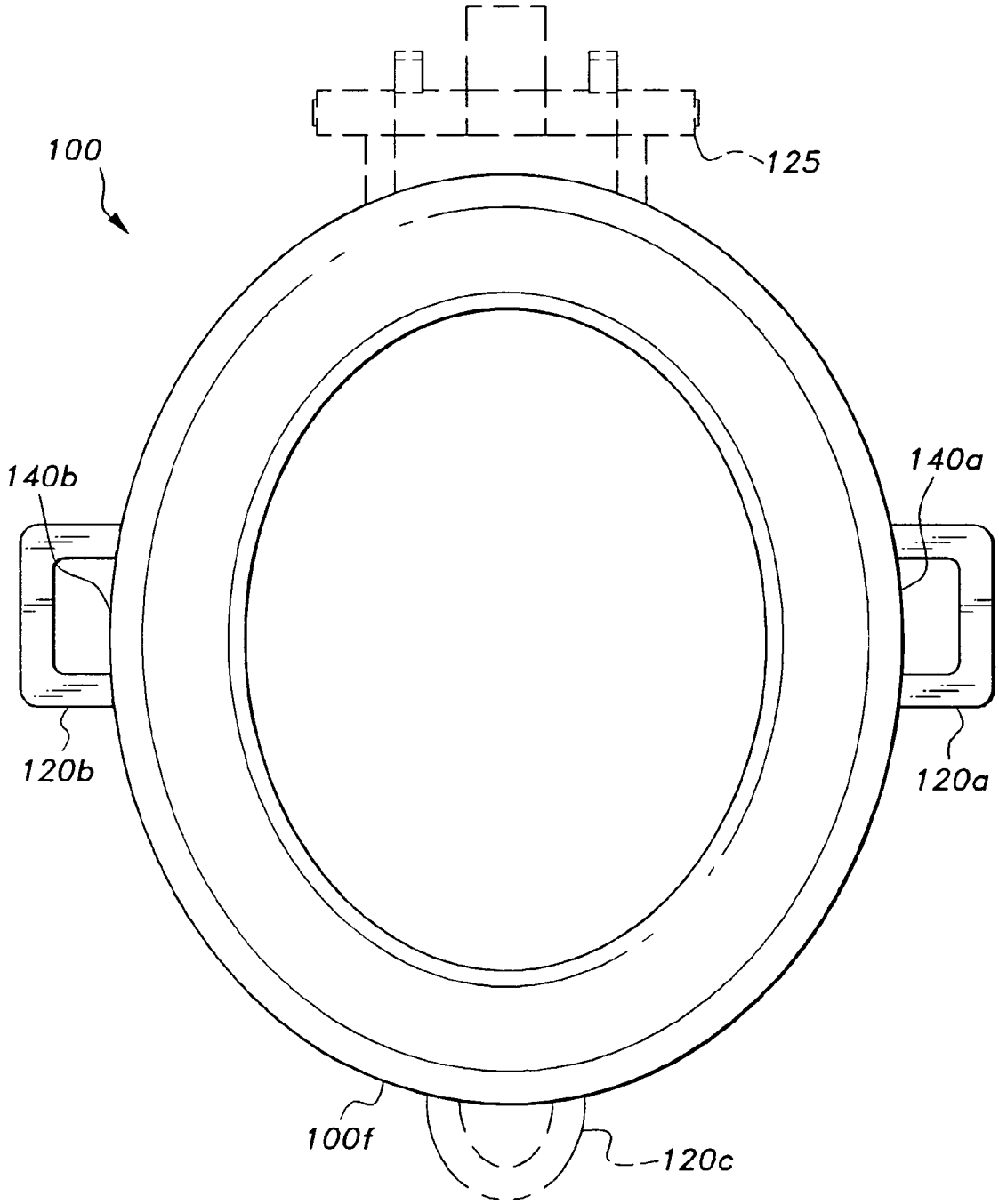
FIG. 2 shows a top planar view of the toilet seat and seat handle combination of FIGS. 1 and 2 according to the present invention.

FIG. 2 shows a top planar view of a toilet seat 100 according to the invention. Each at least one handle 120 are flush fitting with respect to the underside of the toilet seat 100 (see FIG. 3); the seat handles 120 are represented in FIG. 2 by alpha-numeral labels 120*a*, 120*b* and 120*c*. Handle 120*c* is an optional flush fitting handle that is attached to the front 100*f* of seat 100. Seat handles 120*a* and 120*b* respectively extend laterally from the right and left sides 140*a* and 140*b* respectively of toilet seat 100. However, as discussed below, it should be understood that the handles 120 are not limited to flush fitting handles, a section of the handles can, for example, be partially recessed inside grooves 180 (e.g., see FIG. 4C and accompanying description).

Figure 3:
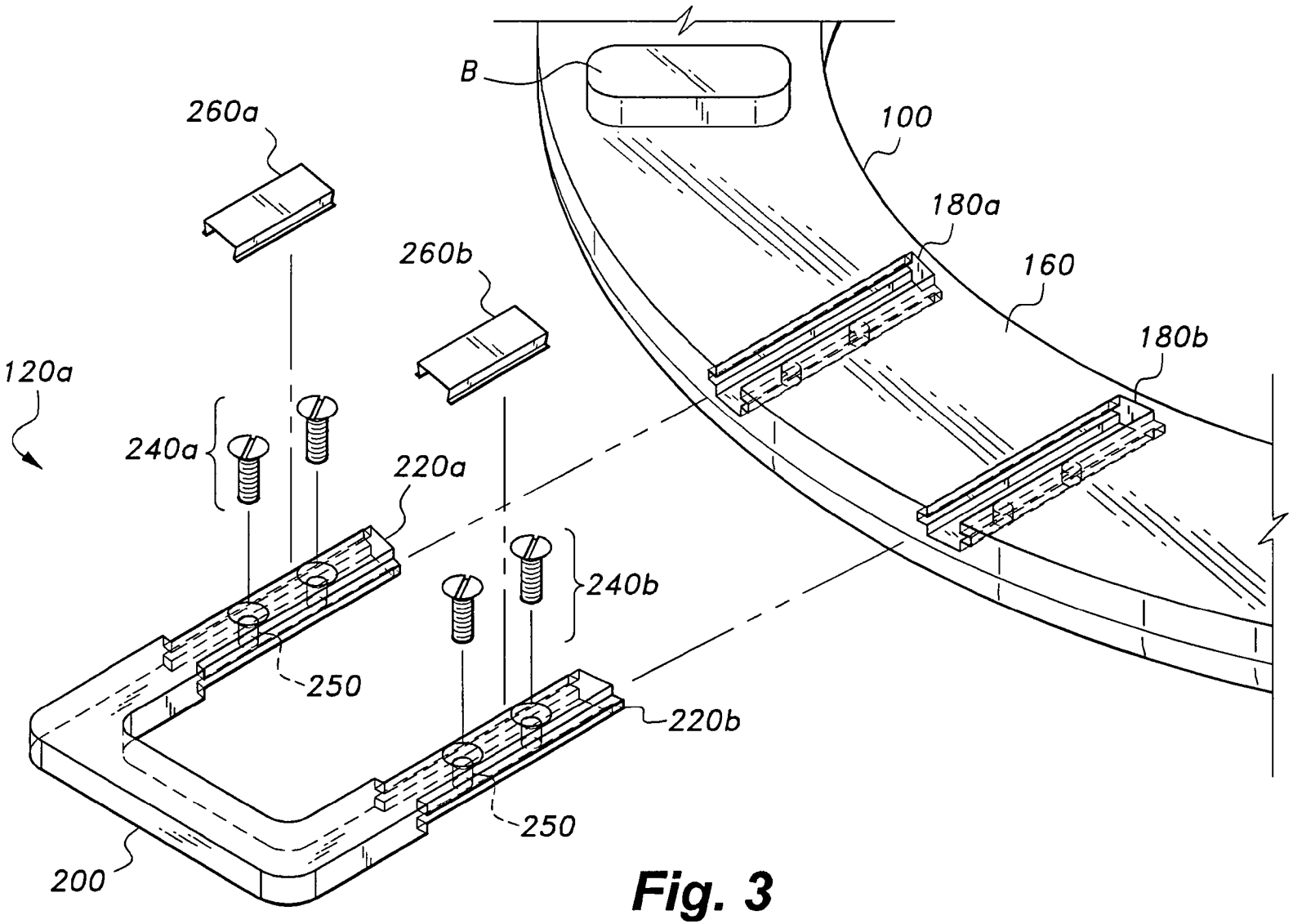
FIG. 3 shows an exploded view of one of a flush fitting toilet seat handle in combination with toilet seat according to the present invention.

FIG. 3 shows an exploded view of one of a flush fitting toilet seat handle 120 in combination with a toilet seat 100, wherein the toilet seat 100 has a bottom side 160 modified with a pair of grooves 180 (represented by alpha-numeral labels 180*a* and 180*b*) to accommodate the opposite ends of handle 120; if the seat 100 is made of wood, the grooves 180 may be cut into the bottom side 160 thereof; if the seat is made of a polymer material, the seat may be molded with grooves 180 in place as a function of the plastic molding process.

Still referring to FIG. 3, handle 120 comprises a substantially U-shaped bracket 200 having two opposite ends 220*a* and 220*b* which act as the male counter parts to grooves 180*a* and 180*b*, respectively. Bracket 200 defines at least one screw-hole 250. Bracket ends 220*a* and 220*b* are shown attached by screws 240 (represented by alpha-numeral labels "240*a*" and "240*b*") through screw-holes 250 to grooves 220*a* and 220*b*, respectively. The screws 240 can be any suitable screw type such as flat-head screws. The grooves 180 in FIG. 3 are approximately parallel and set at a predetermined distance apart in bottom side 160 of toilet seat 100. The term "predetermined distance apart" corresponds to the distance apart required to ensure that the ends 220 of, for example, U-shaped bracket 200 fit inside the grooves 180.

The ends 220 of U-shaped bracket 200 can be slightly convex, i.e., slightly point outwards such that the ends 220 need to be pushed together to fit inside the grooves 180 (such as grooves 180*a* and 180*b*) thereby causing outward pressure on the grooves 180 such that the ends 220 are held firmly in place inside the grooves 180. In this manner the screws 240 (and/or adhesive) would experience less stress when person P grips handle 120. The stress would be spread along the grooves 180.

One or more optional screw cover 260 can be used to cover the heads of screws. In FIG. 3 two optional screw covers 260 (represented as "260*a*" and "260*b*") are used to cover the heads of screws 240*a* and 240*b*. The screw covers 260 may snap or slide into place over screws 240. Adhesive can be used in place of, or in addition to, screws 240 to attach the bracket ends 220*a* and 220*b* to the toilet seat 100.

It should be understood that the handles 120 are not limited to a U-shaped form of bracket but may be any suitable form of handle. For example, handles 120 may have a discontinuous oval or overall circular shape with opposite ends 220. Likewise, grooves 180 are not limited to pairs of substantially parallel grooves, but may be non-parallel to accommodate the opposite ends of oval or circular shaped handles.

Figure 4A:
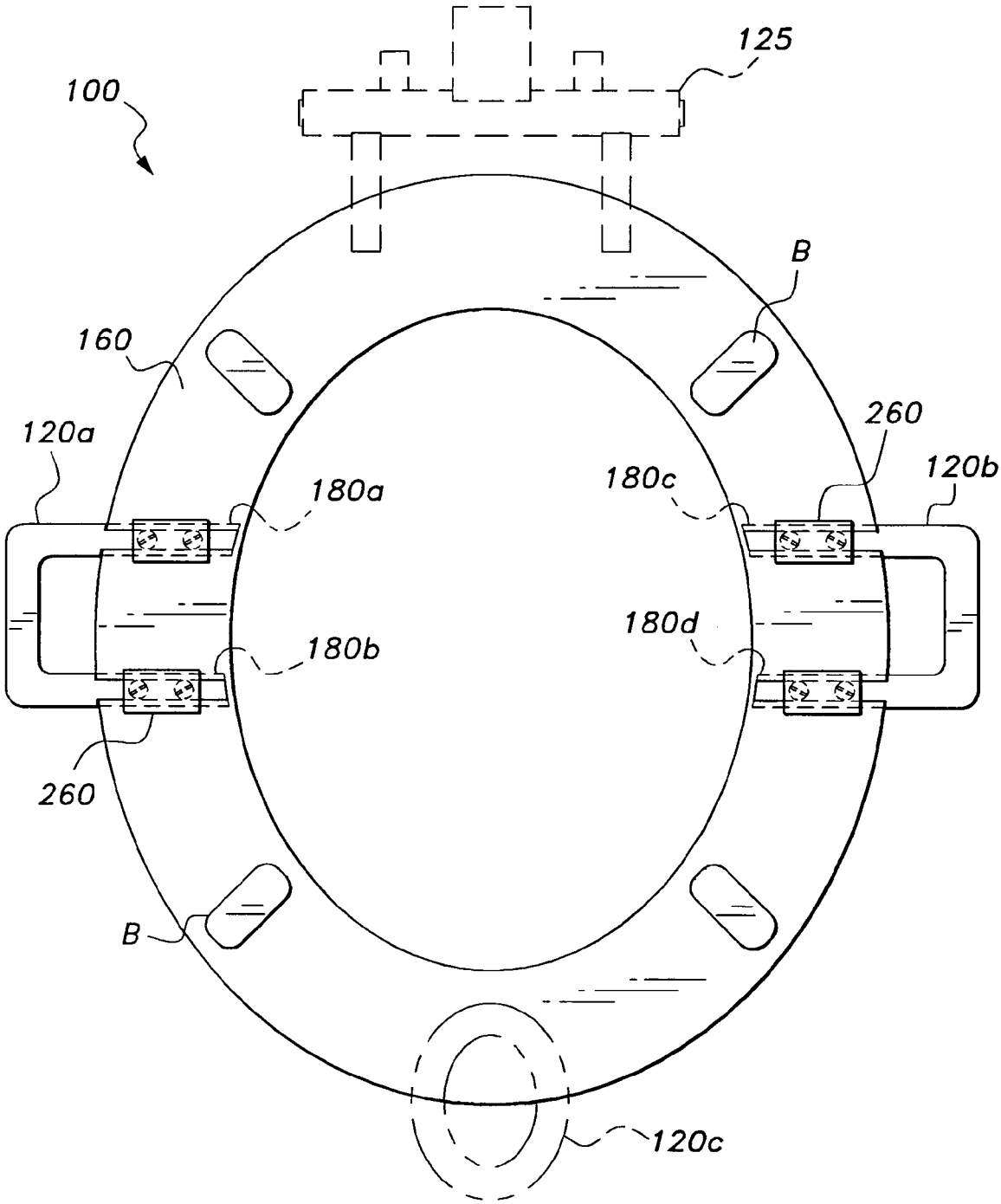
FIG. 4A shows a bottom planar view of the toilet seat and seat handle combination of FIGS. 1 and 2 according to the present invention.
Figure 4B:
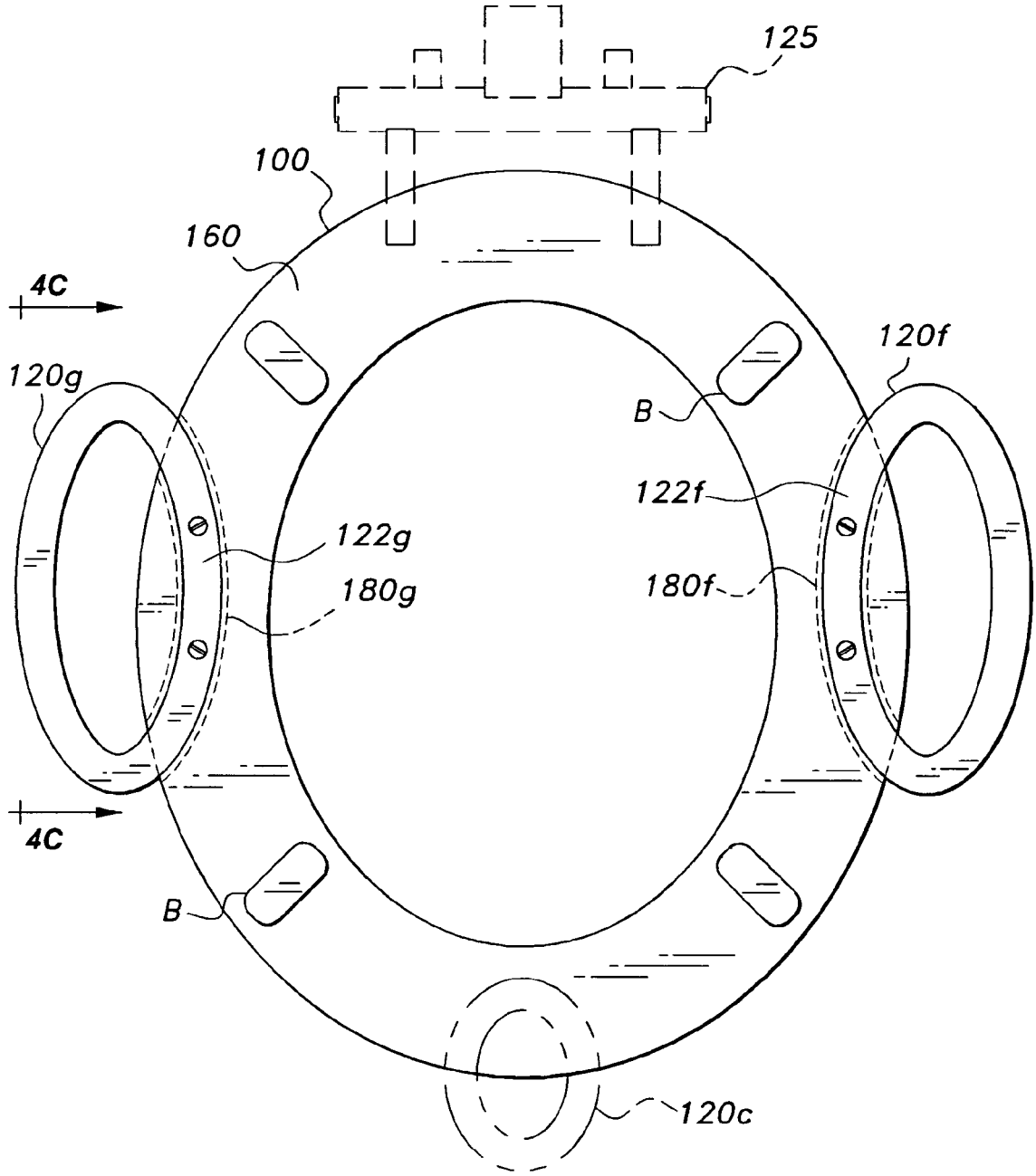
FIG. 4B is a planar view of the bottom of a toilet seat in combination with at least one continuous oval shaped handle according to the present invention.

In addition, the handles 120 may be continuous and therefore lack opposite ends 220 in which case the groove 180 adopts a complementary shape to accommodate a section 122 of the handle 120*d* (see FIG. 4B). Whatever the shape of the at least one handle 120*d*, the depth of groove 180 is sufficient to accommodate a section 122 of handle 120*d* such that the handle fits snuggly inside groove 180 and flush with respect to the bottom side 160 of seat 100.

It will also be understood that in the context of a discontinuous handle such as U-shaped bracket 200 with opposite ends 220*a* and 220*b*, the term "flush fitting" refers to the bracket ends 220 when they fit substantially flush in the bottom side 160 of toilet seat 100. Because the ends 220 are substantially flush fitting the toilet seat 100 is not likely to warp or distort when under load, i.e. when a person P sits on the toilet seat. Prior art toilet seat handles that are attached directly onto the bottom side of a toilet seat can over time cause warping or distortion in the toilet seat particularly in instances where bumpers B (see FIG. 3) are not fitted to the bottom of a toilet seat.

FIG. 4A is a planar view of the bottom of a toilet seat 100 fitted with flush fitting handles 120*a* and 120*b* according to the invention that slot into first and second pairs of grooves 180 in the bottom side 160 of seat 100 (first and second pairs of grooves 180 are represented by alpha-numeral labels "180*a*" and "180*b*", "180*c*" and "180*d*", respectively). Optional handle 120*c* is also shown in FIG. 4A. Optional handle 120*c* may or may not be a flush fitting handle.

FIG. 4B is a planar view of the bottom of a toilet seat 100 in combination with at least one continuous oval shaped handle 120 according to the present invention; the at lest one continuous oval shaped handle 120 is represented by alpha-numeral labels "120*f*" and "120*g*". Handles 120*f* and 120*g* lack opposite ends 220 (such as 220*a* and 220*b* in FIG. 3). Groove 180 is shaped to accommodate at least one section 122 of each handle. The depth of groove 180 is sufficient such that at least one section 122 is partially recessed in the groove 180 (see FIG. 4C). Thus, it should be understood that the at least one handle 120 is not limited to a particular shape or configuration; e.g., handles 120 may adopt a circular like shape like that of optional handle 120*c*. Also, the groove 180 is not limited to a particular depth so long as a section of handle (e.g., sections 220*a*, 220*b*, or 122) is at least partially recessed inside at least one groove 180. Put another way, at least one groove 180 has sufficient depth to ensure the at least one section fits at least partially inside the at least one groove 180 with respect to the bottom side 160 of toilet seat 100. A partially recessed section of handle 120 is less likely to interfere with the correction operation of bumpers P when fitted on the bottom 160 of toilet seat 100 (see FIG. 4C).

Figure 4C:
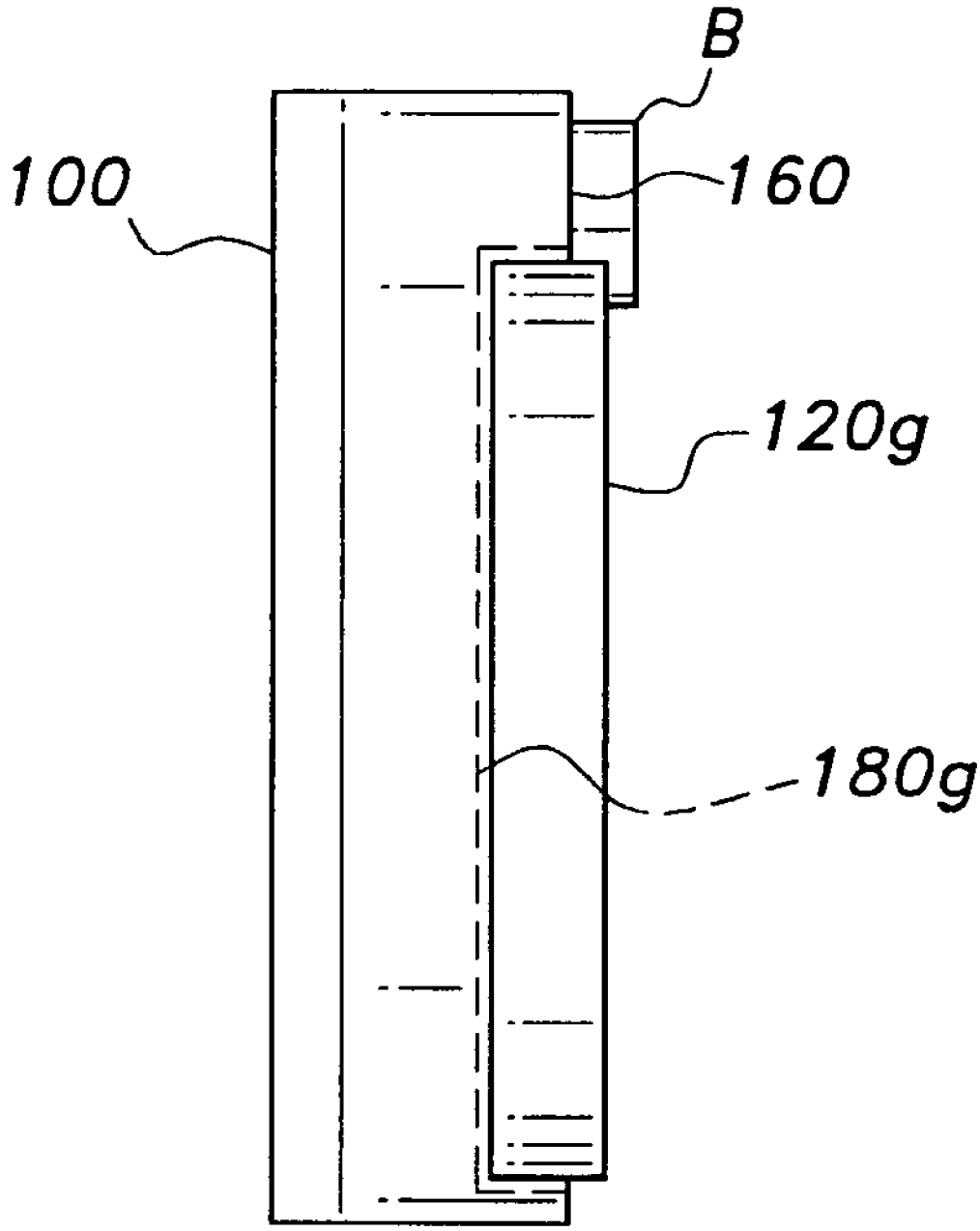
FIG. 4C shows a side view of the toilet seat combination between lines 4C in FIG. 4B.

FIG. 4C shows a side view of the toilet seat combination between lines 4C in FIG. 4B. Specifically, FIG. 4C shows a section 120*g* of handle 120*g* partially recessed inside groove 180*g*. The partially recessed section 122*g* is recessed sufficiently to avoid interfering with the normal functioning of bumpers B attached to the bottom side 160 of toilet seat 100.

Referring to the FIGURES in general, the invention is an apparatus adapted to assist a person getting off and sitting on a toilet seat. The apparatus comprises a toilet seat 100 in combination with a means for griping. The means for griping may take various forms such as, for example, the discontinuous handle 120*a* and/or continuous handle 120*d* (see FIGS. 3 and 4B, respectively). The means for gripping further comprises at least one groove 180 in bottom side 160 of seat 100; the at least one groove 180 is sized to accommodate at least one section of handle (such as ends 220*a* and 220*b* of handle 120*a* shown in FIG. 3 or at least one section 122 of handle 120*d* shown in FIG. 4B), wherein the at least one section 122 is at least partially recessed or fits flush inside groove 180 with respect to the bottom side 160 of seat 100. The means for gripping further comprises an attachment means such as screws 240 and/or adhesive to attach the at least one section 122 of handle to the bottom side 160 of seat 100.

It is to be understood that the present invention is not limited to the embodiments described above, but encompasses any and all embodiments within the scope of the following claims.

The invention claimed is:

1. A toilet seat and toilet seat handle combination comprising:

a toilet seat, wherein said toilet seat has an upper side and a bottom side, right and left sides, and at least one pair of first and second approximately parallel grooves at a predetermined distance apart in said bottom side, each groove having a countersunk portion;

at least one handle, wherein said handle is a substantially U-shaped bracket having two opposite ends which fit respectively inside said grooves, said groves having sufficient depth to ensure said opposite ends either sit approximately flush or are partially recessed inside said grooves, the said at least one U-shaped bracket having a tongue;

wherein said U-shaped bracket has ends that point slightly away from each other thereby causing outward pressure on the grooves, including said tongue in said countersunk portion, such that the U-shaped bracket ends are held firmly in place inside said grooves.

2. The toilet seat and toilet seat handle combination according to claim 1, wherein a pair of handles flush fit to the right and left side of said toilet seat.

3. The toilet seat and toilet seat handle combination according to claim 1, wherein said bottom side comprises at least one bumper, and wherein said at least one groove has sufficient depth to ensure said at least one section is partially recessed inside said at least one groove.

4. The toilet seat and toilet seat handle combination according to claim 1, wherein said opposite ends are attached by screws to said grooves.

5. The toilet seat and toilet seat handle combination according to claim 1, wherein said opposite ends are attached by screws to said grooves, and wherein screw head covers cover said screws.

6. The toilet seat and toilet seat handle combination according to claim 1, wherein a pair of handles are flush fit to the right and left side of said toilet seat, and wherein said handles are attached by screws to said at least one groove, and wherein one or more screw head covers cover said screws.

* * * * *